US007309245B2

(12) United States Patent
Sadatoku

(10) Patent No.: US 7,309,245 B2
(45) Date of Patent: Dec. 18, 2007

(54) CARD CONNECTOR

(75) Inventor: Hiroki Sadatoku, Kanagawa (JP)

(73) Assignee: Kyocera Elco Corporation, Kanagawa (JP)

( * ) Notice: Subject to any disclaimer, the term of this patent is extended or adjusted under 35 U.S.C. 154(b) by 0 days.

(21) Appl. No.: 11/625,887

(22) Filed: Jan. 23, 2007

(65) Prior Publication Data

US 2007/0178733 A1 Aug. 2, 2007

(30) Foreign Application Priority Data

Jan. 30, 2006 (JP) ..... 2006-020766

(51) Int. Cl.
*H01R 13/62* (2006.01)

(52) U.S. Cl. ..... 439/159

(58) Field of Classification Search ..... 439/159, 439/160
See application file for complete search history.

(56) References Cited

U.S. PATENT DOCUMENTS 6,319,029 B2 * 11/2001 Nishioka ..... 439/159
2005/0070142 A1 * 3/2005 Hanzawa et al. ..... 439/159

* cited by examiner

*Primary Examiner*—Tho D. Ta
(74) *Attorney, Agent, or Firm*—McCormick, Paulding & Huber LLP

(57) ABSTRACT

A card connector for accommodating a removable card, includes a housing into and from which the removable card is inserted and ejected; connector terminals which come in contact with contacts of the removable card, respectively, when the removable card is inserted into the housing; a slider which moves in a card insertion direction and a card ejection direction, opposite to the card insertion direction, when the removable card is inserted and ejected into and from the housing, respectively; a first coil spring which biases the slider in the card insertion direction; and a second coil spring which biases the slider in the card ejection direction. Each of the first coil spring and the second coil spring remains in contact with the slider and the housing, respectively, regardless of the position of the slider.

11 Claims, 11 Drawing Sheets

PRIOR ART

PRIOR ART

CARD CONNECTOR

CROSS REFERENCE TO RELATED APPLICATION

The present invention is related to and claims priority of the following pending application, namely, Japanese Patent Application No. 2006-20766, filed on Jan. 30, 2006.

BACKGROUND OF THE INVENTION

1. Field of the Invention

The present invention relates to a card connector for a memory card, an IC card or a card-type cartridge which is used in memory-capable electronic devices (e.g., cellular phones, personal computers, various PDAs, digital cameras and digital audiovisual apparatuses) or home game machines.

2. Description of the Prior Art

Memory cards and IC cards, in which IC and memory chips are integrated, and also card-type cartridges are widely used in memory-capable electronic devices (e.g., cellular phones, personal computers, various PDAs (personal digital assistances), digital cameras and digital audiovisual apparatuses) and home game machines. Card connectors are used to connect such memory cards, IC cards or card-type cartridges to circuit boards of the memory-capable electronic devices.

FIGS. 10 and 11 show an example of a conventional card connector disclosed in Japanese Unexamined Patent Publication No. 2002-367720. This card connector is provided with a housing 122, into and from which a removable card (memory card) 121 can be inserted and ejected, respectively. The housing 122 is composed of a housing body 123 and a housing cover 124 which covers the top of the housing body 123. The housing body 123 is provided with a thin bottom plate 125, a front wall 126 formed at the front end of the housing 123, and a side wall 127 formed on one side of the housing 123. Ten electric terminals 128 are arranged side-by-side in parallel to one another along the front end of the bottom plate 125.

An arm receiving groove 134 is formed in an inner surface of the front wall 126, and a circular groove (hole) 135 (see FIG. 11) having a small diameter is formed in the front portion of the arm receiving groove 134. A front end 137 of an arm 136 is fitted into the circular groove 135 to be pivoted thereat. In addition, a spring receiving recess 139 is formed in the front wall 126. Additionally, the housing body 123 is provided at a rear corner thereof with a corner wall 140, and a spring accommodation groove 141 is formed in the corner wall 140.

Opposite side edges of the housing cover 124 are bent downward so that the housing cover 124 can be fitted on the housing body 123 to cover the top of the housing body 123. In addition, the housing cover 124 is provided in the vicinity of one edge thereof with an arm retaining leaf 143 which is formed by bending a part of the housing cover 124 to press the arm 136 downward.

A slider 144 is installed on the bottom plate 125 on one edge thereof. The slider 144 is provided with a substantially rectangular-bar-shaped guide portion 145 and a contacting portion 146 which projects inwards from the front end of the guide portion 145 to allow the front end of the removable card 121 to come in contact with the contacting portion 146. In addition, a heart-shaped cam 147 including an engaging recess 148 is formed in a top surface of the guide portion 145 to allow a rear end 138 of the arm 136 to move slidingly along the heart-shaped cam 147.

Additionally, a spring accommodation groove 149 is formed in the guide portion 145 at the rear end thereof. Front and rear ends of an extension coil spring 151 are accommodated in the spring accommodation groove 149 and the spring accommodation groove 141 to be supported thereby, respectively. A cutout portion 156 is formed in the contacting portion 146 so that the rear end of a compression coil spring 158 is engaged in the cutout portion 156.

Inserting the removable card 121 into the housing 122 causes the slider 144 to move forward against the resilient force of the extension coil spring 151 and causes the compression coil spring 158 to be engaged in the spring receiving recess 139 and compressed. Subsequently, the rear end 138 of the arm 136 is engaged with the engaging recess 148 of the heart-shaped cam 147 to thereby lock the slider 144 and the removable card 121 in their respective insertion/installation positions in which contacts of the removable card 121 are in contact with the electric terminals 128.

To eject the removable card 121 in this state, the removable card 121 is further pressed into the housing 122 beyond the insertion/installation position. Pressing the removable card 121 in this manner causes the rear end 138 of the arm 136 to be disengaged from the engaging recess 148. Thereupon, the slider 144 and the removable card 121 move rearward (downward as viewed in FIG. 11) by the resilient force of the compression coil spring 158, so that the aforementioned contacts of the removable card 121 are disengaged from the electric terminals 128, and then the slider 144 and the removable card 121 further move rearward to their respective ejected positions.

However, in the above described card connector, since the slider 144 and the removable card 121 are biased in a direction to eject the removable card 121 by the two coil springs, i.e., the extension coil spring 151 and the compression coil spring 158, there is a possibility of the removable card 121 popping out of the housing 122 suddenly beyond the ejected position and accidentally falling out when the removable card 121 is ejected. Additionally, in the case where a shock is applied to the card connector, there is a possibility of the removable card 121 being unlocked, and thereby popping out by accident.

In view of this conventional card connector, to prevent such a card pop-out problem from occurring, a card connector in which a leaf spring instead of the extension coil spring 151 is disposed between the rear end of a slider and the rear end of a housing along the card eject direction has been proposed, for example in Japanese Unexamined Patent Publication No. 2005-203231. In this publication, it is disclosed that a shock created by a movement of the slider and transmitted to the removable card at the time of ejection of the removable card can be reduced since this shock is cushioned by the elasticity of the leaf spring, thereby making it possible to prevent the removable card from popping out accidentally.

However, although this card connector, in which the leaf spring is disposed as a cushioning member (or a shock absorber) for cushioning shock at the time of ejection of the removable card, has the effect of preventing the removable card from popping out accidentally, there is a problem with shock that is caused by a collision between the slider and the leaf spring which occurs from a state where the slider and the leaf spring are away from each other; moreover, it is necessary to reduce the size of the leaf spring in recently-manufactured small, light-weight card connectors, and accordingly, there is a problem with providing a sufficient stroke or load of the leaf spring necessary for absorbing the shock created upon the slider stopping.

SUMMARY OF THE INVENTION

In view of the drawbacks of the prior art mentioned above, the present invention provides a card connector for accommodating a removable card, including a housing into and from which the removable card is inserted and ejected; connector terminals which come in contact with contacts of the removable card, respectively, when the removable card is inserted into the housing; a slider which moves in a card insertion direction and a card ejection direction, opposite to the card insertion direction, when the removable card is inserted and ejected into and from the housing, respectively; a first coil spring which biases the slider in the card insertion direction; and a second coil spring which biases the slider in the card ejection direction. Each of the first coil spring and the second coil spring remains in contact with the slider and the housing, respectively, regardless of the position of the slider.

It is desirable for the first coil spring and the second coil spring to be coaxially arranged along the card insertion direction and the card ejection direction.

It is desirable for a biasing force exerted on the slider by resiliency of the second coil spring to be greater than a biasing force exerted on the slider by resiliency of the first coil spring.

It is desirable for at least a part of the slider to be held between a positioning portion formed on the housing and the second coil spring in a state where the removable card is not inserted into the housing.

It is desirable for each of the first coil spring and the second coil spring to include a compression coil spring.

It is desirable for the removable card to include a memory card.

It is desirable for the memory card to include a micro-sized SD memory card.

It is desirable for the housing to include a housing body and a housing cover which covers the housing body, wherein the slider is mounted on the housing body to be slidable thereon inside the housing, and the first coil spring and the second coil spring are positioned on opposite sides of the slider along the card insertion direction and the card ejection direction.

It is desirable for the positioning portion to project toward the slider in a direction substantially orthogonal to the card insertion direction and the card ejection direction from the housing.

It is desirable for the slider to include a heart-shaped cam.

It is desirable for the card connector to include a lock member for temporarily holding the removable card when the removable card is inserted into and ejected from the housing, the lock member being mounted to the slider.

In an embodiment, a card connector is provided, including a housing into which a removable card is inserted, including connector terminals arranged inside the housing and coming in contact with contacts of the removable card, respectively, when the removable card is inserted into the housing; a slider positioned in the housing and slidingly movable in a card insertion direction and a card ejection direction, opposite to the card insertion direction, when the removable card is inserted and ejected into and from the housing, respectively; a first spring which biases the slider in the card insertion direction; and a second spring which biases the slider in the card ejection direction. The first coil spring and the second coil spring remain in contact with the slider from opposite directions, respectively, regardless of the position of the slider.

It is desirable for each of the first spring and the second spring to be a compression coil spring.

According to an aspect of the present invention, since the first coil spring and the second coil spring are coaxially arranged along the card insertion/ejection directions, the inserting force of the removable card when inserted into the housing can be reduced by an action of the first coil spring; moreover, the acceleration of the slider can be reduced to a sufficient degree upon the completion of a card ejecting operation since the first coil spring starts functioning as a brake for the slider immediately after the commencement of the card ejecting operation when the removable card is ejected. Furthermore, substantially no shock occurs during the card ejecting operation since the card connector is configured so as not to allow each of the first coil spring, the second coil spring and the slider to bump against each other during the card ejecting operation. This configuration effectively prevents the removable card from suddenly popping out of the housing.

BRIEF DESCRIPTION OF THE DRAWINGS

The present invention will be discussed below in detail with reference to the accompanying drawings, in which.

DESCRIPTION OF THE PREFERRED EMBODIMENTS

Figure 1:
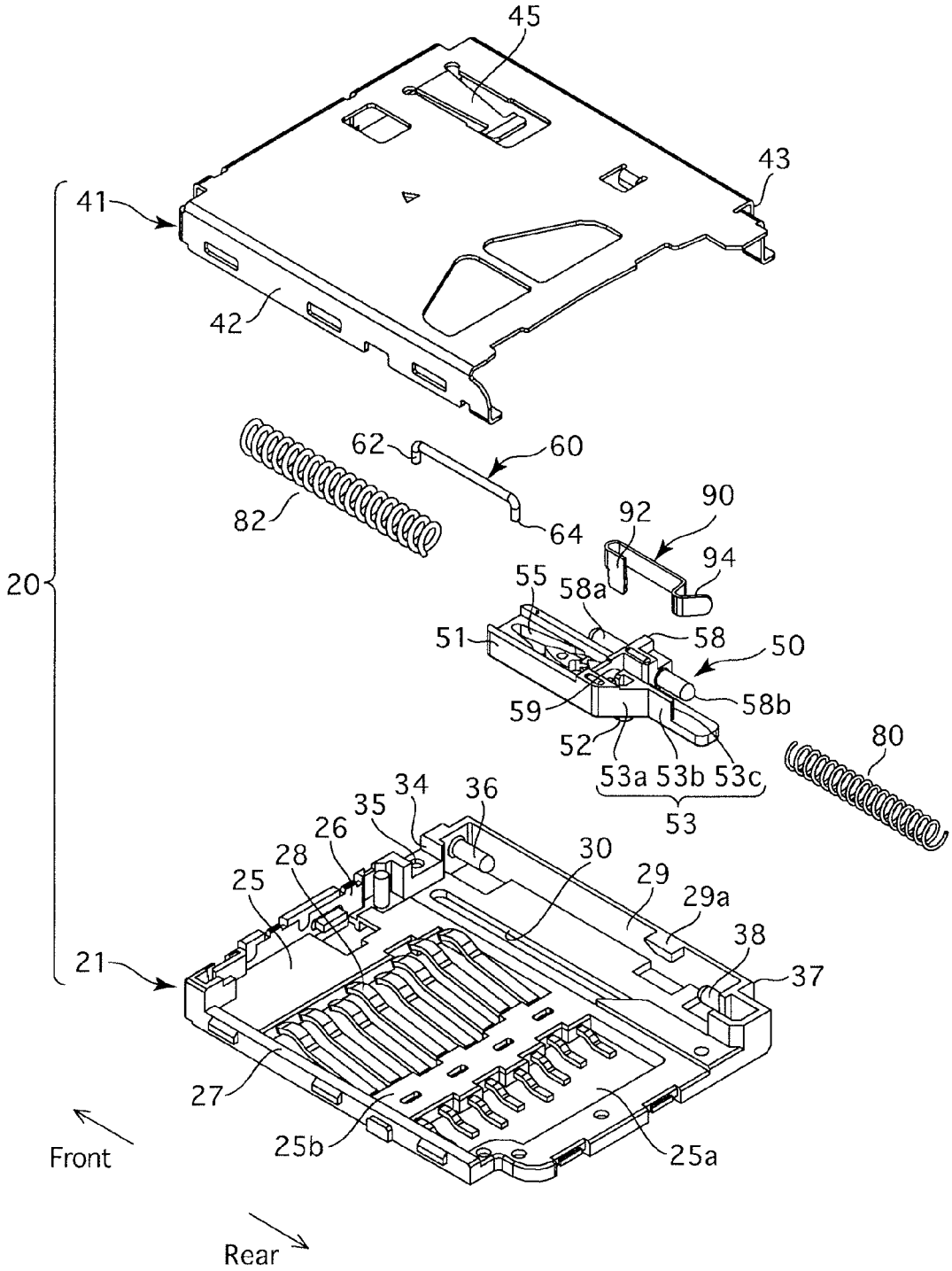
FIG. 1 is an exploded perspective view of an embodiment of a card connector according to the present invention, showing the structure thereof.

As shown in FIG. 1, an embodiment of a card connector according to the present invention is provided with a housing 20, an arm 60, a slider 50, a first coil spring 80, a second coil spring 82 and a metal lock member 90. A card (removable card) 70 can be inserted and ejected into and from the housing 20.

The housing 20 is composed of a housing body 21 and a housing cover 41. The housing body 21 is made of a synthetic resin and is open at the upper and rear sides. The housing cover 41 is made of metal and shaped to cover the housing body 21.

The housing body 21 is provided with a bottom plate 25, a front wall 26 formed at the front end of the bottom plate 25, and a side wall 27 formed on one side of the bottom plate 25. The housing body 21 is provided at a substantially center of the bottom plate 25 with a recess 25*a* in which a predetermined number of electric terminals (connector terminals; i.e., eight electric terminals in the embodiment of FIG. 1) 28 are arranged side-by-side in parallel to one another. As is well known in the art, the card 70 is provided with contacts (not shown) corresponding to the terminals 28. Each electric terminal 28 is molded integrally with (or press-fitted in) a central wall portion 25*b* which is formed integral with the bottom plate 25 to extend in a widthwise direction thereof substantially at the center of the recess 25*a*. The bottom plate 25 is provided in the vicinity of another side wall 29 thereof with a guide slot (elongated through hole) 30 which is elongated in the forward/rearward direction (vertical direction as viewed in FIG. 2).

The housing body 21 is provided, in the front wall 26 in front of the guide slot 30, with an arm receiving recess 34, and is further provided in the bottom of the arm receiving recess 34 with a circular groove (hole) 35 having a small diameter. A front end 62 of the arm 60 is fitted into the circular groove 35 to be pivoted thereat. The arm 60 is in the shape of a pin, the front and rear ends 62 and 64 of which are bent downwards.

The housing body 21 is provided with a second spring holding pin 36 which extends rearward from a portion of the front wall 26 in the vicinity of the side wall 29 to be substantially parallel to the side wall 29. The housing body 21 is provided at a rear corner thereof with a corner wall 37, and is further provided with a first spring holding pin 38 which extends forward from the corner wall 37, toward the second spring holding pin 36, to be coaxial therewith. The housing body 21 is provided, on the side wall 29 at a position thereon closer to the corner wall 37 than a front right corner (upper right corner as viewed in FIG. 2) of the housing body 21, with a positioning portion 29*a* which projects inwards, toward the slider 50.

Opposite side edges of the housing cover 41 are bent downward to form side walls 42 and 43. The side walls 42 and 43 are engaged with the side walls 27 and 29 of the housing body 21, upon the housing cover being fitted onto the housing body, so that the housing cover 41 covers the top of the housing body 21. The housing cover 41 is provided, at a position thereon which faces the front end of the guide slot 30 of the housing body 21, with an arm retaining leaf 45 which is formed as a cantilever extending portion by bending a part of the housing cover 41 to extend obliquely downward and rearwards. When the housing cover 41 is fitted on the housing body 21 to cover the housing body 21, the arm retaining leaf 45 presses the arm 60 downward. The housing cover 41 is mounted, together with the housing body 21, to a base plate (not shown).

The slider (eject bar) 50 is provided with a substantially rectangular-bar-shaped guide portion 51, a contacting portion 53 and a spring support part 58. The contacting portion 53 is provided at a rear end thereof with a side surface 53*b* which extends in the forward/rearward direction, and is further provided with a beveled side surface 53*a* which extends obliquely outwardly forwards (obliquely rightwardly downwards as viewed in FIG. 2) from a rear end of the rectangular-bar-shaped guide portion 51 to the front end of the side surface 53*b*. The spring support part 58 projects outward (rightward as viewed in FIG. 2) from the rear end of the guide portion 51 of the slider 50. The slider 50 is installed on the bottom plate 25 in the vicinity of the side wall 29 so that the spring support part 58 faces the side wall 29. The front end of the card 70 comes into contact with the contacting portion 53 upon the card 70 being inserted into the housing 20.

Figure 2:
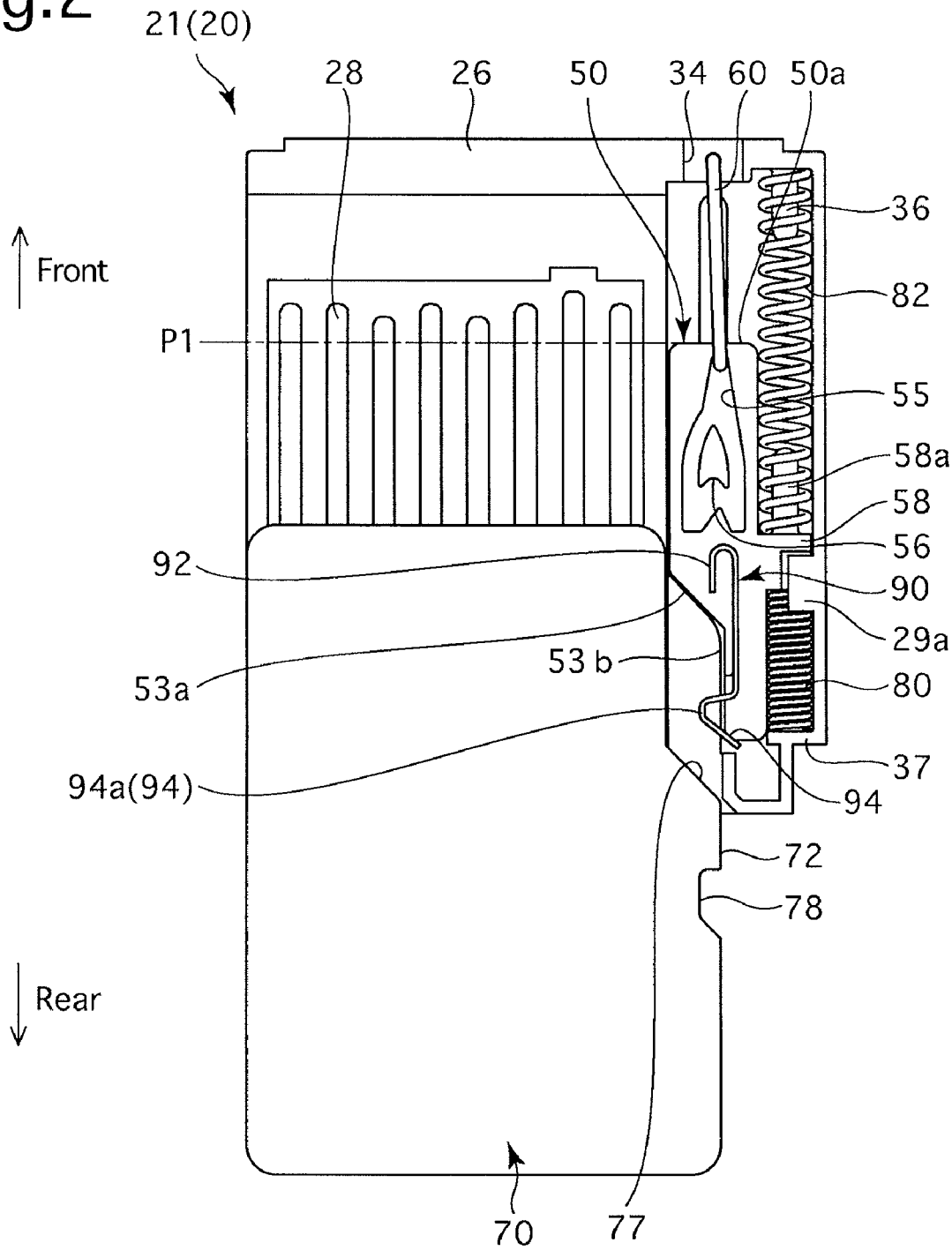
FIG. 2 is a plan view of the card connector shown in FIG. 1 and a card, showing a state where the card is in the process of being inserted into the card connector.

A heart-shaped cam 55 is formed as a recess in a top surface of the guide portion 51 of the slider 50. As shown in FIG. 2, an engaging recess 56 is formed at the rear end of the heart-shaped cam 55. The slider 50 is provided, on opposite sides of the spring support part 58 in the forward/rearward direction, with a second pin 58*a* and a first pin 58*b* which extend forward and rearward from the spring support part 58, toward the second spring holding pin 36 and the first spring holding pin 38, to be coaxial with the second spring holding pin 36 and the first spring holding pin 38, respectively. The rear end 64 of the arm 60 is movable in the heart-shaped cam 55 while sliding along the interior wall (cam surface) thereof with the front end 62 pivoted at the circular groove 35. The slider 50 is provided on a bottom surface of the guide portion 51 with a guide projection 52 which projects downward. Upon the slider 50 being mounted in place on the bottom plate 25 of the housing body 21, the guide projection 52 is engaged in the guide slot 30 of the housing body 21 so that the slider 50 is guided in the forward/rearward direction by the engagement of the guide projection 52 with the guide slot 30. Alternatively, it is possible for the slider 50 to be positioned via the use of other portions of the slider 50 and the housing body 21 instead of the guide projection 52 and the guide slot 30.

The slider 50 is provided, between the contacting portion 53 and the spring support part 58 in a top surface of the guide portion 51 in the vicinity of the rear end thereof, with a substantially U-shaped groove 59. A hook-shaped front end 92 of the lock member 90 that is formed by bending the front end of the lock member 90 is loosely fitted into the U-shaped groove 59. A rear end portion 94 of the lock member 90 is formed as a wedge-shaped portion (folded portion) 94*a* having a substantially V-shaped cross section and is formed by bending a rear end portion of the lock member 90 firstly inward (leftward as viewed in FIG. 2) and thereafter obliquely rearwardly outwards (obliquely downwardly rightwards as viewed in FIG. 2). A rear left corner (lower left corner as viewed in FIG. 2) of the side surface 53*b* of the contacting portion 53 is removed to form a notched portion 53*c*, through which the wedge-shaped portion 94*a* extends. The rear end portion 94 is resiliently deformable laterally (horizontally as viewed in FIG. 2). It is possible for the lock member 90 to be made of a synthetic resin instead of metal so long as it has substantially the same degree of resiliency as the lock member 90 made of metal. Alternatively, a lock member corresponding to the lock member 90 can be formed integral with part of the slider 50.

The first coil spring 80 is a compression coil spring, the front and rear ends of which are fitted on the first pin 58*b* and the first spring holding pin 38 to be supported thereby, respectively. The second coil spring 82 is a compression coil spring, the front and rear ends of which are fitted on the second spring holding pin 36 and the second pin 58*a* to be supported thereby, respectively. The first coil spring 80 and the second coil spring 82 are coaxially arranged in the forward/rearward direction. Due to this arrangement, the slider 50 becomes stable dynamically to be movable relative to the housing body 21 in the forward/rearward direction.

The card 70 can be, e.g., a micro-Sized sized SD memory card. The card 70 is provided, on the bottom face at the front end thereof, with a plurality of contact mounting grooves (not shown; known in the art) which are formed to correspond to the electric terminals 28 and in which a corresponding plurality of contacts (not shown) are installed, respectively. The card 70 is further provided at a front corner thereof with a beveled contacting surface 77, the surface of which corresponds to the surface of the beveled side surface 53*a* of the slider 50 so that the beveled side surface 53*a* comes into surface contact with the beveled contacting surface 77 upon the card 70 being inserted into the housing body 21 of the housing 20. The card 70 is further provided, on a right side thereof (as viewed in FIG. 2) behind the beveled contacting surface 77, with a lock recess 78 in which the rear end portion 94 of the lock member 90 can be engaged.

Actions and operations of the above illustrated embodiment of the card connector will be hereinafter discussed with reference to FIGS. 2 through 5 when the card 70 is inserted and ejected into and from the card connector.

(1) Card not-Inserted State (Initial State)

In a state where the card 70 is not yet inserted into the housing 20, or in a state (as shown in FIG. 2) where the card 70 is inserted into the housing 20 to a degree that the beveled contacting surface 77 of the card 70 does not yet come into contact with either the beveled side surface 53*a* of the slider 50 or the wedge-shaped portion 94*a* of the lock member 90, a force (biasing force) F1 pressing the slider 50 rearward by the resiliency of the second coil spring 82 and a force (biasing force) F2 pressing the slider 50 forward by the resiliency of the first coil spring 80 are exerted on the slider 50 concurrently. The force F1 by the second coil spring 82 is predetermined to be greater than the force F2 by the first coil spring 80. Additionally, an initial position P1 of a front end surface 50*a* of the slider 50 is determined by the engagement of a rear end surface of the spring support part 58 with the positioning portion 29*a* of the side wall 29. In a state where the card 70 is absent in the housing 20, the spring support part 58 of the slider 50 is held between the positioning portion 29*a* of the side wall 29 and the rear end of the second coil spring 82. The first coil spring 80 has sufficient resiliency so that the rear and front ends thereof remain in contact with the corner wall 37 and the spring support part 58, respectively, even if the slider 50 is moved in the forward/rearward direction. Likewise, the second coil spring 82 has sufficient resiliency so that the front and rear ends thereof remain in contact with the front wall 26 and the spring support part 58, respectively, even if the slider 50 is moved in the forward/rearward direction. Additionally, since a difference between the aforementioned two forces F1 and F2 exerted by the second coil spring 82 and the first coil spring 80 (hereinafter referred to as an initial force Fs (=F1−F2)) is continuously loaded on the slider 50, the slider 50 does not move or produce any unusual noise even if vibrations or shocks are applied to the card connector in a state where the card 70 is not yet inserted into the card connector.

(2) Card Temporarily-Held State

Figure 3:
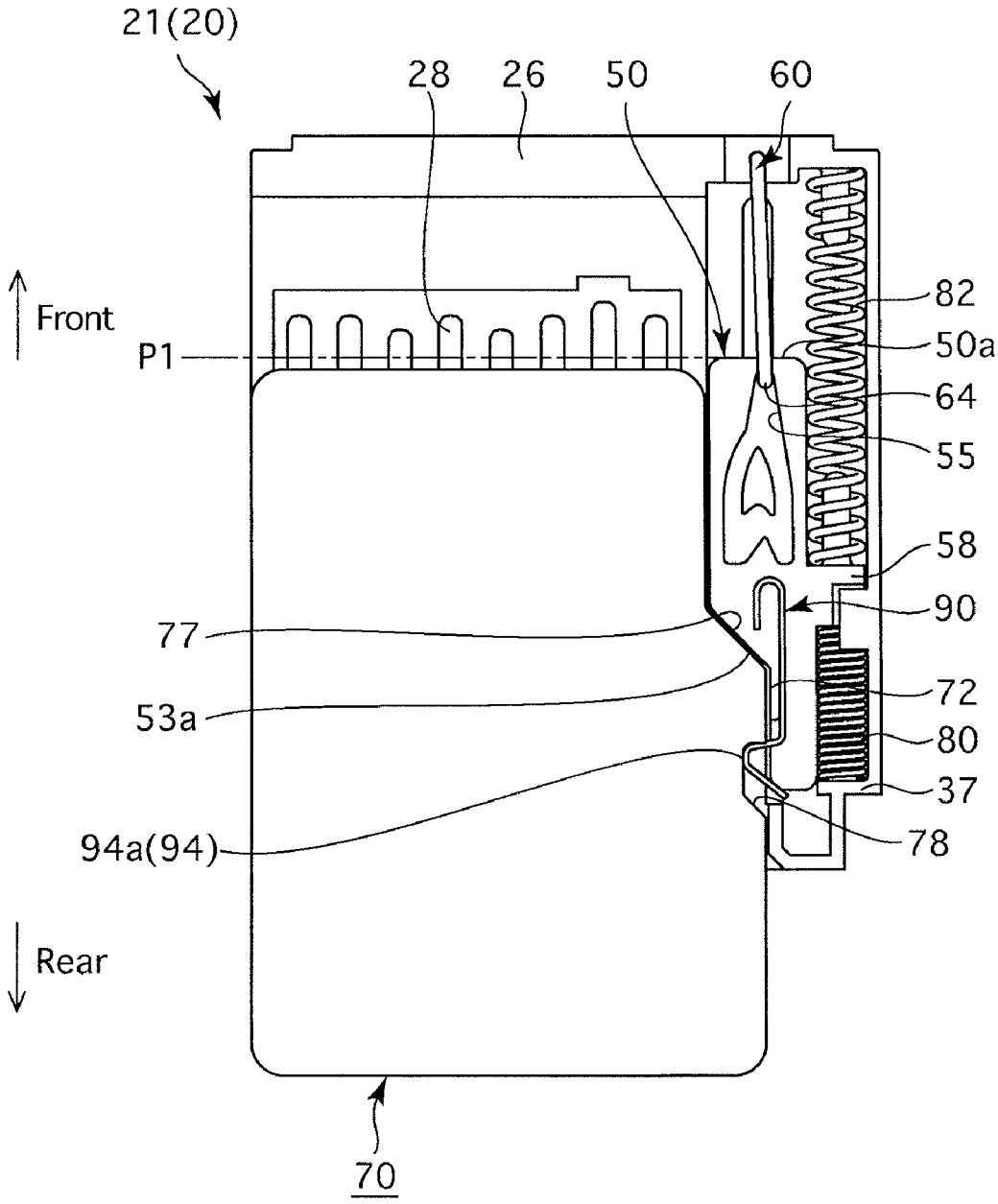
FIG. 3 is a view similar to that of FIG. 2, showing a state where the card is held temporarily in the card connector.

Further inserting the card 70 into the housing 20 from the state shown in FIG. 2 causes the wedge-shaped portion 94*a* of the lock member 90 to firstly come into contact with the beveled contacting surface 77 and subsequently slide over the beveled contacting surface 77 onto a side surface 72 of the card 72, which is positioned between the beveled contacting surface 77 and the lock recess 78 in the forward/rearward direction, while the lock member 90 is resiliently deformed outwards (toward the first coil spring 80). Thereafter, further inserting the card 70 into the housing 20 causes the beveled contacting surface 77 to come into contact with the beveled side surface 53*a* of the slider 50 and concurrently causes the rear end portion 94 (the wedge-shaped portion 94*a*) to be engaged into the lock recess 78 as shown in FIG. 3, thus causing the card 70 to enter a temporarily-held state thereof, in which the card 70 is held temporarily in the housing body 21. During the period of insertion from the initial state shown in FIG. 1 until the temporarily-held state shown in FIG. 3, the front end surface 50*a* of the slider 50 remains stationary at the initial position (temporarily-held position) P1 by the initial force Fs, while the rear end 64 of the arm 60 is positioned at the front end of the heart-shaped cam 55. Since the beveled contacting surface 77 is formed in a beveled surface extending obliquely forwardly inwards and since a portion of the lock member 90 which ranges from the wedge-shaped portion 94*a* to the rearmost end of the lock member 90 is inclined (angled) to correspond to the inclination (angle) of the beveled contacting surface 77, a force (Tin) necessary for bringing the rear end portion 94 (the wedge-shaped portion 94*a*) to be engaged in the lock recess 78 of the card 70 can be made smaller than the initial force Fs (=F1−F2) that is necessary for moving the slider 50 which is in the initial state thereof.

(3) Card Over-Stroke State

Figure 4:
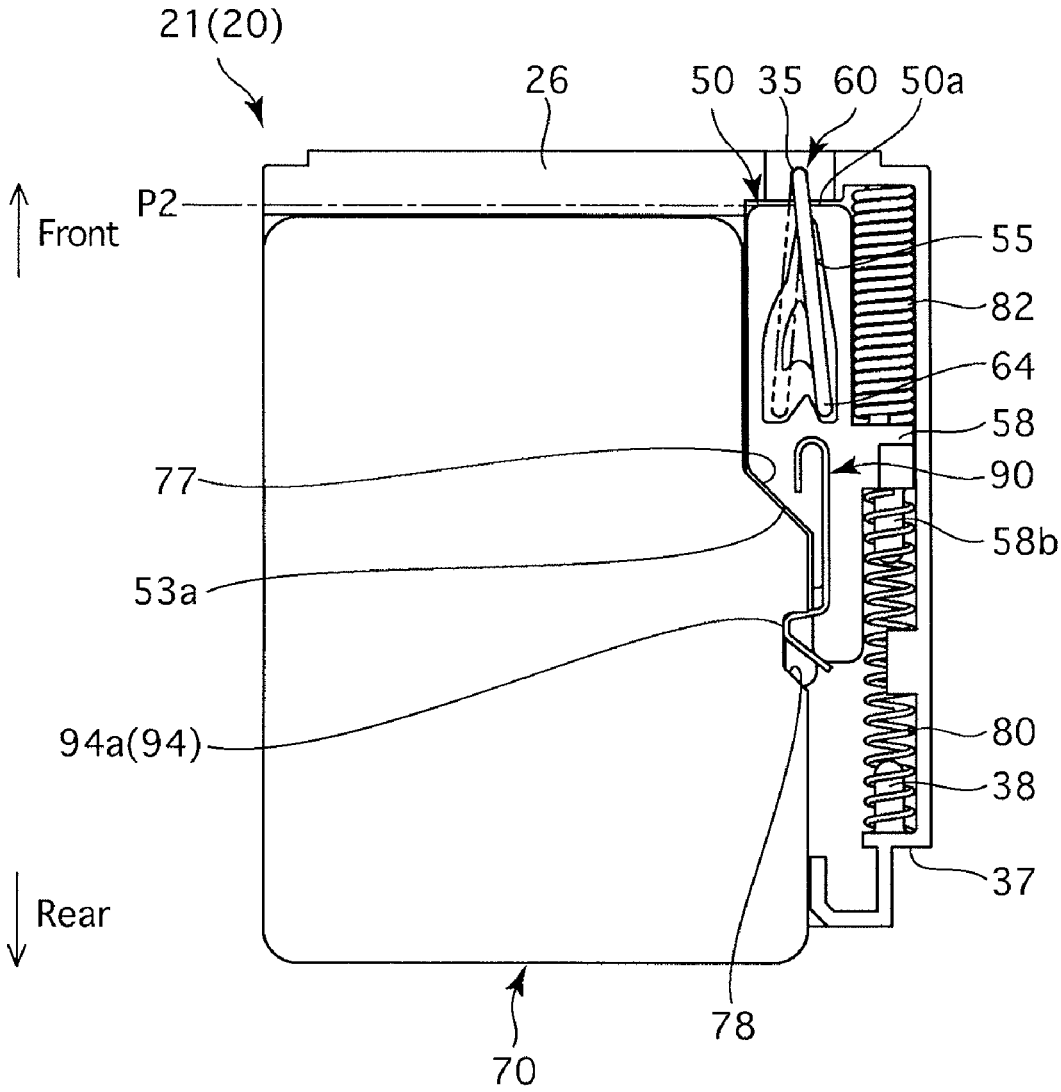
FIG. 4 is a view similar to that of FIG. 2, showing a state where the card has been inserted into the card connector to a point at which a slider reaches an over-stroke position thereof.

Further inserting the card 70 into the housing 20 from the state shown in FIG. 3 causes the slider 50 to start moving with the card 70 forward against the resilient force of the second coil spring 82. Further inserting the card 70 into the housing 20 causes the second coil spring 82 to be further compressed with the front and rear ends of the first coil spring 80 remaining in contact with the spring support part 58 and the corner wall 37, respectively, by the resiliency of the first coil spring 80, and causes the front end of the card 70 to come into contact with the front wall 26 of the housing body 21, and also causes the front end surface 50*a* of the slider 50 to reach an over-stroke position P2 (this state will be hereinafter referred to as an over-stroke state) as shown in FIG. 4. Since the force which presses the slider 50 forward by the resiliency of the first coil spring 80 is continuously exerted on the slider 50 until the slider 50 reaches the over-stroke state, the manual force required for inserting the card 70 into the housing 20 is reduced by this force. Moreover, since the first coil spring 80 and the second coil spring 82 are coaxially arranged, the position and the behavior of each of the first coil spring 80 and the second coil spring 82 become stable, which makes it possible for the card 70 to be inserted into the housing 20 in the correct direction and in the correct location. Note that the force which presses the slider 50 forward by the resiliency of the first coil spring 80 can be predetermined so as to become zero in the over-stroke state. In addition, until the slider 50 enters the over-stroke state, the arm 60 swings along the contour of the heart-shaped cam 55 with the circular groove 35 serving as a pivot of the arm 66, while the rear end 64 of the arm 60 is positioned inside of the heart-shaped cam 55 at a rear end thereof. It is possible that the force which presses the slider 50 forward by the resiliency of the first coil spring 80 be predetermined either not to become zero even in the over-stroke state or to become zero when the front end surface 50*a* of the slider 50 reaches a lock position P3, which will be discussed later.

(4) Card Locked State (Card Inserted/Installed State)

Figure 5:
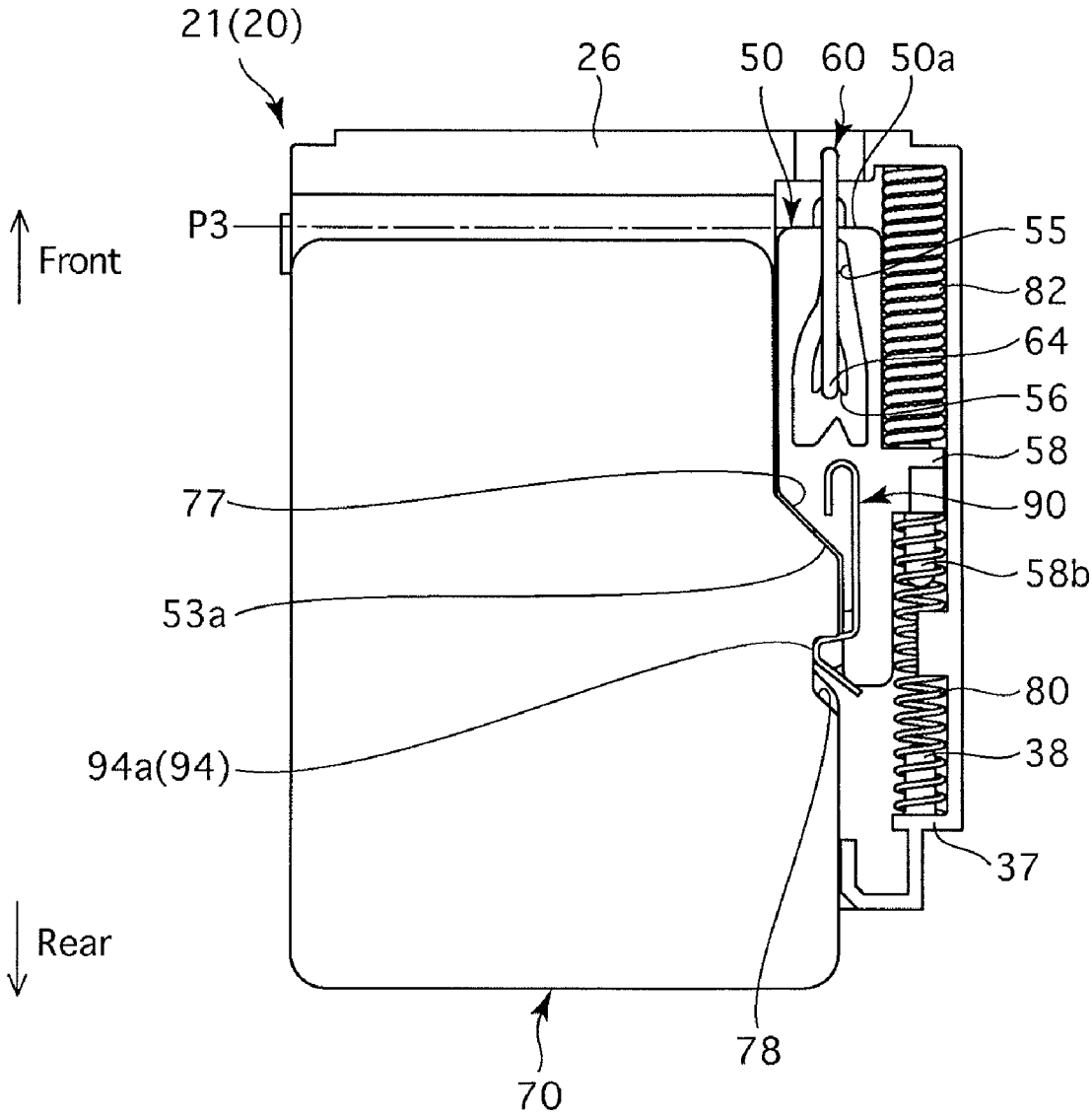
FIG. 5 is a view similar to that of FIG. 2, showing a state where the card has been inserted into the card connector and installed therein into position.

If the card inserting operation that inserts the card 70 into the housing 20 is stopped upon the slider 50 reaching the over-stroke state, the slider 50 moves with the card 70 rearward to correspond to the balance between the resiliencies of the second coil spring 82 and the first coil spring 80, and thereafter the rear end 64 of the arm 60 is engaged in the engaging recess 56 of the heart-shaped cam 55 as shown in FIG. 5. As a consequence, the card 70 is held in place in a predetermined insertion/installation position, so that the front end surface 50*a* of the slider 50 reaches the aforementioned lock position P3. At this time, each contact (not shown) of the card 70 comes in contact with the associated terminal 28 so that the card 70 enters an electrically-connected state in which the card 70 is electrically connected to a specific circuit (not shown). In this state, since the slider 50 is subjected to the two forces which press the slider 50 rearward and forward by the resiliencies of the second coil spring 82 and the first coil spring 80, respectively, and also since the force exerted on the slider 50 by the second coil spring 82 is greater than the force exerted on the slider 50 by the first coil spring 80, the rear end 64 of the arm 60 is securely engaged in the engaging recess 56. Therefore, even if a shock is applied to the card 70 inserted into the card connector, the card 70 does not come out of the housing 20 accidentally.

(5) Insertion and Ejection of the Card

When one wants to eject the card 70 from the card connector, he or she pushes the card 70 forward (inward), beyond the aforementioned insertion/installation position thereof shown in FIG. 5, to eject the card 70 from the card connector with the aid of the resiliencies of the second coil spring 82 and the first coil spring 80. Namely, pushing the card 70 forward, beyond the aforementioned insertion/installation position thereof, causes the slider 50 (the beveled side surface 53*a* of which is in contact with the beveled contacting surface 77 of the card 70) to move with the card 70 forward to thereby move the front end surface 50*a* of the slider 50 from the lock position P3 toward the over-stroke position P2. Due to this movement, the rear end 64 of the arm 60 which is engaged in the engaging recess 56 of the heart-shaped cam 55 is disengaged therefrom to be positioned in the heart-shaped cam 55 at a rear outer end thereof. In this state, if the card inserting operation that inserts the card 70 into the housing 20 is stopped, the slider 50 moves rearward (downward as viewed in FIG. 4) until the front end surface 50*a* of the slider 50 reaches the temporarily-held position (initial position) P1 (see FIG. 3). In this state, if the rear end of the card 70 is pulled rearward, the rear end portion 94 of the lock member 90 is resiliently deformed outward. Thereupon, the lock member 90 is disengaged from the lock recess 78 to thereby allow the card 70 to be removed from the housing 20.

During the process of ejecting the card 70, upon the card inserting operation (in which the card 70 is inserted into the housing 20) being stopped after the engagement between the rear end 64 of the arm 60 and the engaging recess 56 is released, the two forces which press the slider 50 rearward and forward by the resiliencies of the second coil spring 82 and the first coil spring 80, respectively, are continuously exerted on the slider 50. Namely, during this time, a state where the front and rear ends of the second coil spring 82 are in pressing contact with the front wall 26 and the spring support part 58, respectively, and the front and rear ends of the first coil spring 80 are in pressing contact with the spring support part 58 and the corner wall 37, respectively, is maintained. Therefore, the force exerted on the slider 50 during the process of inserting the card 70 into the housing 20 and the force exerted on the slider 50 during the process of ejecting the card 70 from the housing 20 are mutually identical at each corresponding different positions of the slider 50 in the forward/rearward direction as shown in FIG. 6A. Additionally, a force pressing the card 70 inward by the resiliency of the rear end portion 94 of the lock member 90 is continuously exerted on the card 70. This force (holding force) (Tout) is greater than the aforementioned initial force Fs (=F1−F2) for moving the slider 50 which is in the initial state thereof. Therefore, the card 70 is prevented from popping out (coming out suddenly) of the housing 20 suddenly by the force which presses the slider 50 rearward by the resiliency of the second coil spring 82; rather, the card 70 moves rearward while gradually reducing the acceleration thereof to ensure the engagement of the rear end portion 94 of the lock member 90 into the lock recess 78, so that the card 70 is securely held in the temporarily-held position.

Figure 6B:
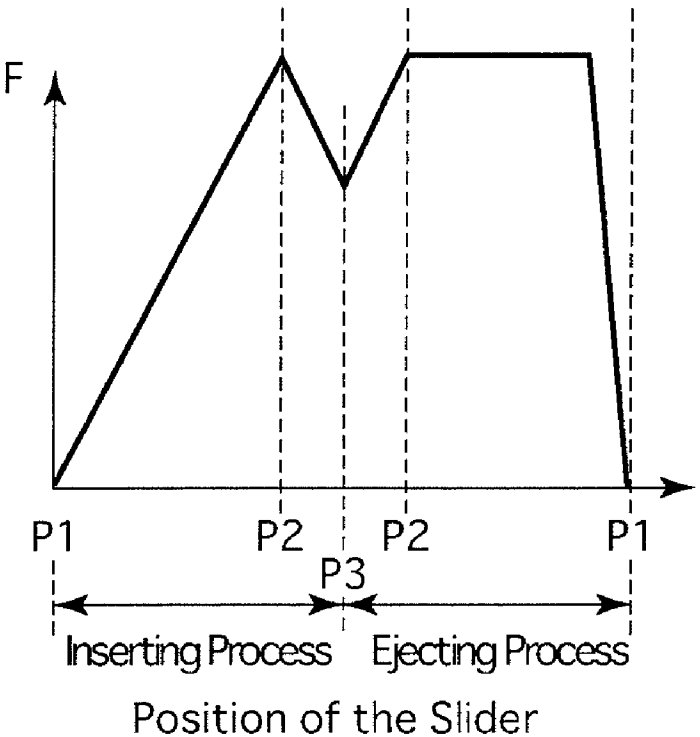
FIG. 6B is a graph similar to that of FIG. 6A, showing variations of a force exerted on a slider in the process of inserting/ejecting the card into and from a conventional card connector.
Figure 6A:
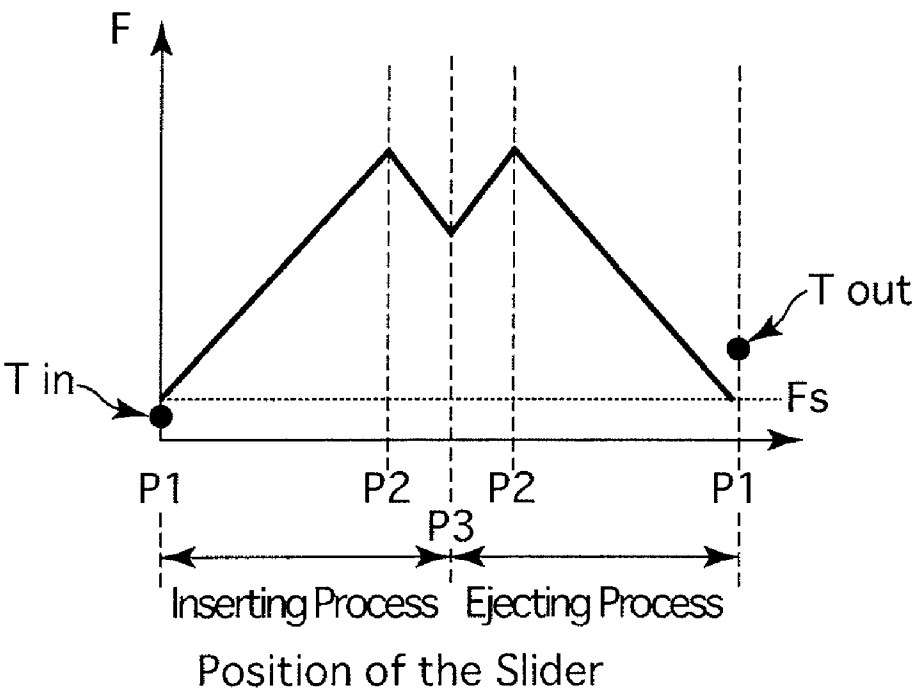
FIG. 6A is a graph showing variations of a force exerted on the slider in the process of inserting/ejecting the card into and from the card connector in the case of the embodiment of the card connector according to the present invention, wherein the vertical axis and the horizontal axis represent the force exerted on the slider and the position of the slider in the forward/rearward direction thereof.

Unlike the above illustrated embodiment of the card connector, in a conventional cord connector, a force exerted on a slider (which corresponds to the slider 50) in the process of ejecting a card (which corresponds to the card 70) from the housing of the card connector during the period from the over-stroke position P2 to the temporarily-held position (initial position) P1 initially remains constant as shown in FIG. 6B. This shows that the slider runs freely with no reduction of the acceleration thereof during this period. Due to this behavior of the slider, the acceleration of slider suddenly falls at the temporarily-held position. This sudden deceleration of the slider produces a great inertial force of the card, thus causing the card to pop out (come out suddenly) of the housing beyond the temporarily-held position.

Furthermore, in the above illustrated embodiment of the card connector, since the first coil spring 80 and the second coil spring 82 are coaxially arranged, the resilient forces of these two springs act linearly in a common straight line, which makes it possible to stabilize the position and the behavior of each the slider 50 and the card 70 during the ejecting operation of the card 70.

A modified embodiment (second embodiment) of the card connector will be hereinafter discussed with reference to FIGS. 7 through 9.

Elements of this modified embodiment of the card connector which are similar to those of the previous embodiment of the card connector are designated by the same reference numerals, and a detailed description for such elements is omitted from the following description.

Figure 7:
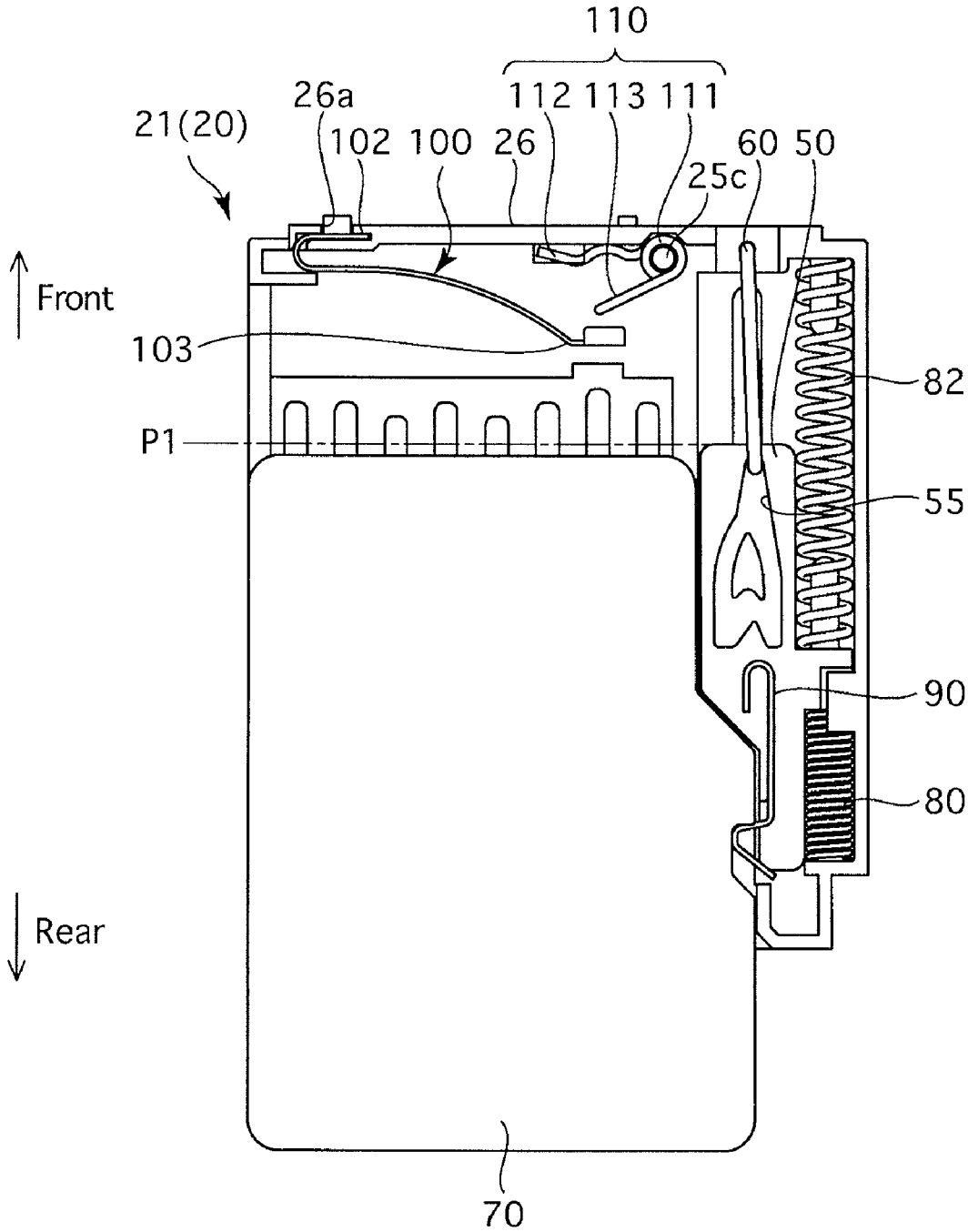
FIG. 7 is a plan view of a modified embodiment of the card connector, showing a state where the card is held temporarily in the card connector.
Figure 8:
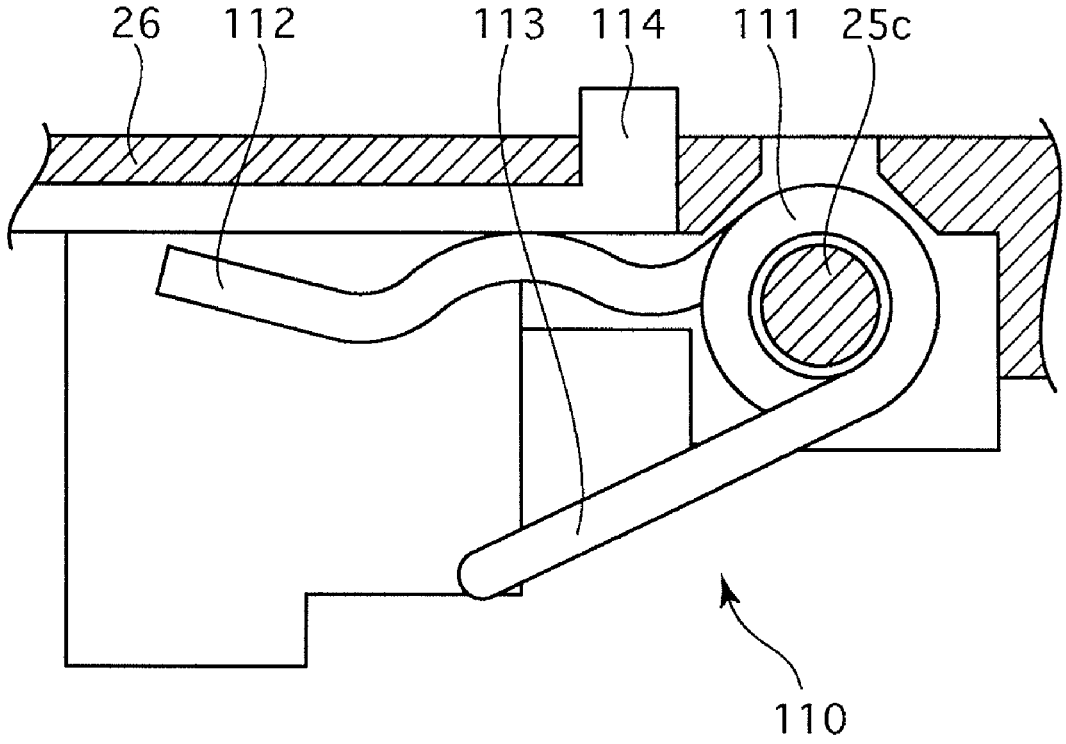
FIG. 8 is an enlarged longitudinal cross sectional view of a second switch terminal and a portion around the periphery thereof.
Figure 9:
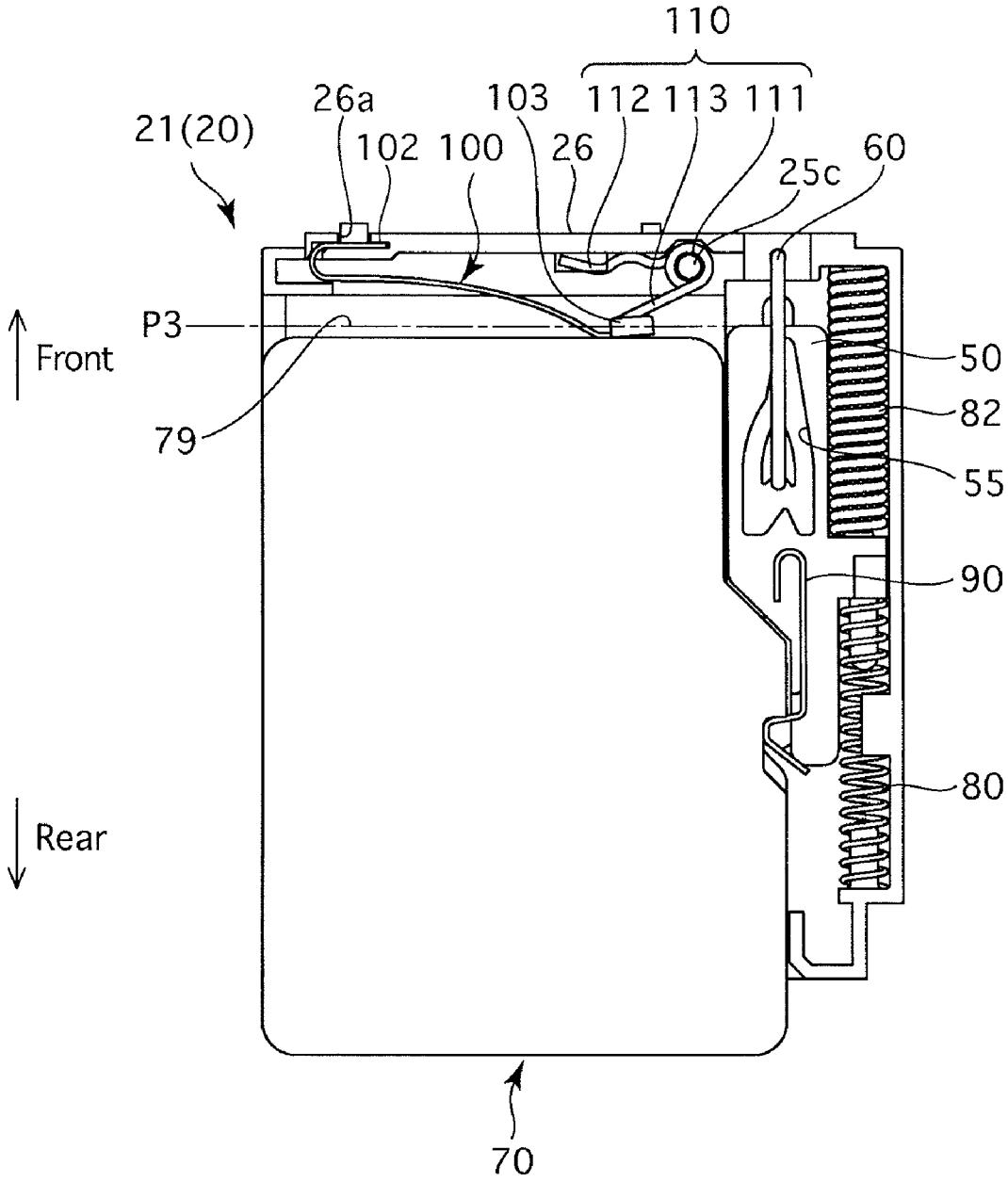
FIG. 9 is a view similar to that of FIG. 7, showing state where the card has been inserted into the card connector and installed therein into position.
Figure 10:
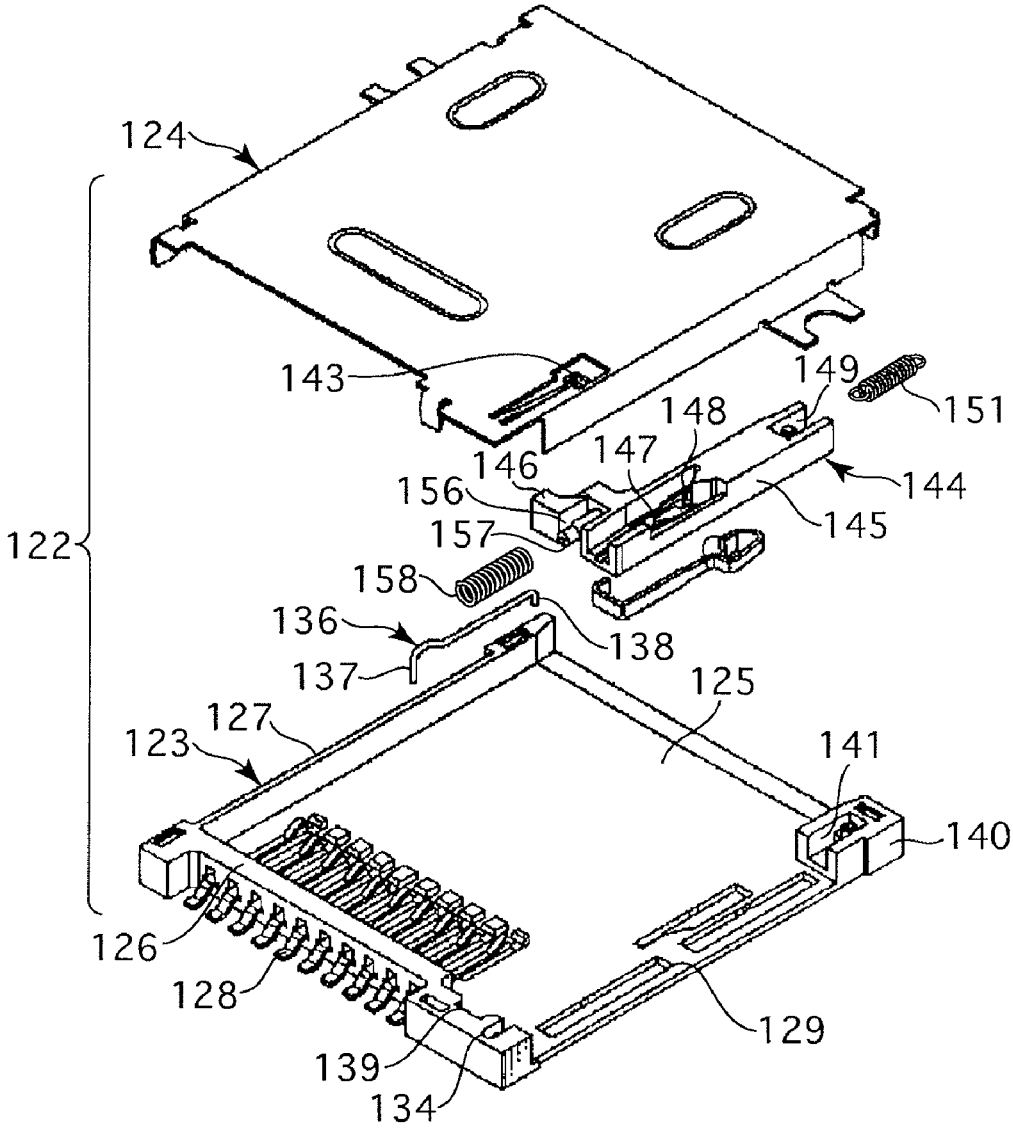
FIG. 10 is an exploded perspective view of a conventional card connector, showing the structure thereof.
Figure 11:
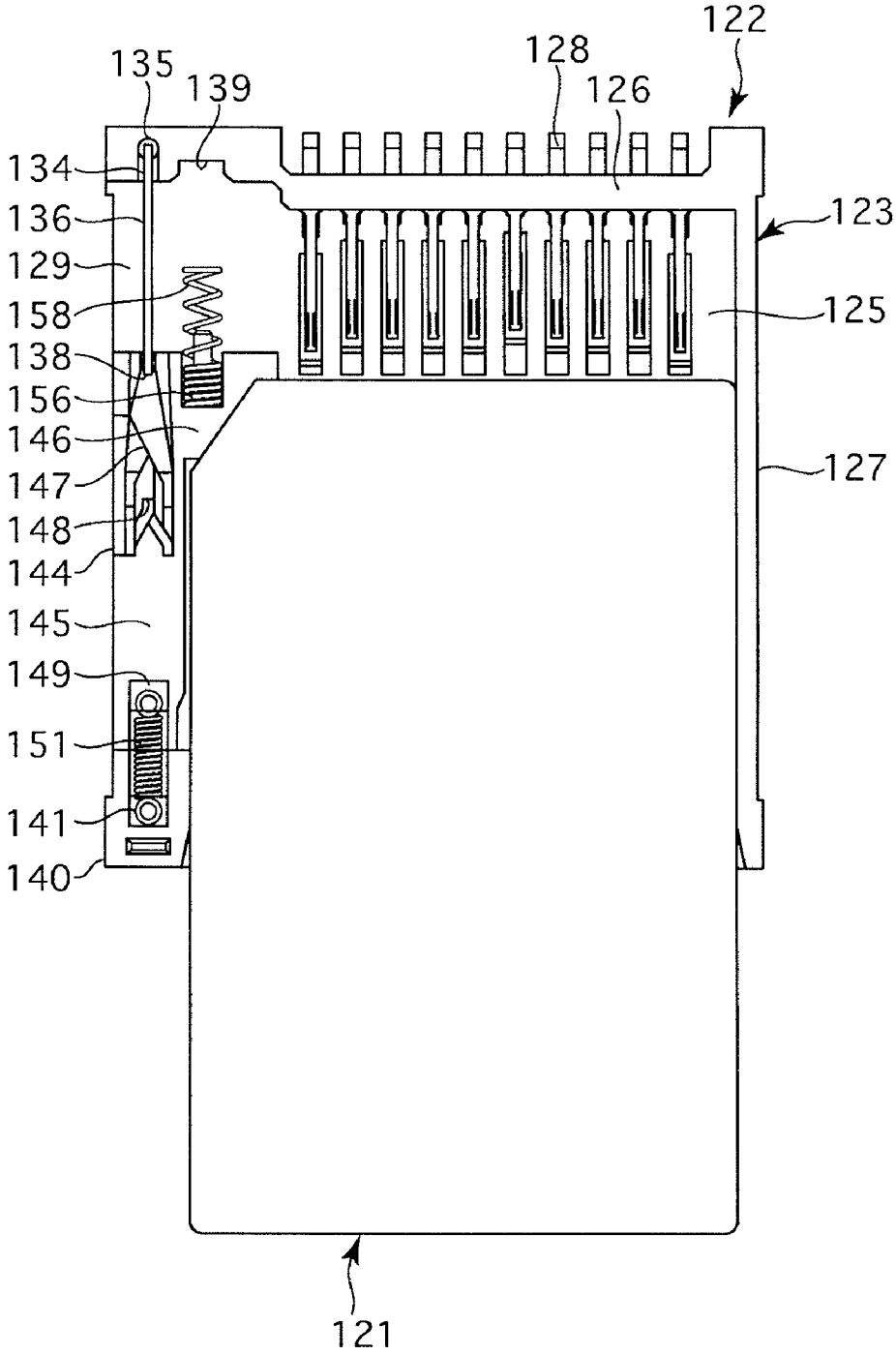
FIG. 11 is a plan view of the conventional card connector shown in FIG. 10 and a card, showing a state where the card is in the process of being inserted into the card connector.

As shown in FIGS. 7 through 9, for detection of the presence of the card 70 in the housing 20, the card connector is provided with a first switch contact 100 and a second switch contact 110 which are brought into contact with each other to thereby be electrically connected to each other upon an insertion of the card 70 into the housing 20.

The first switch contact 100 is formed as a leaf spring. A front end portion 102 of the first switch contact 100, which is formed by bending a part of the first switch contact 100 in the vicinity of the front end thereof, is engaged in an engaging groove 26*a* formed in the front wall 26, while a rear end portion 103 of the first switch contact 100 is positioned behind the front wall 26 in the housing body 21. The first switch contact 100 is electrically connected to a mounting substrate (not shown).

The second switch contact 110 is formed as a helical torsion (coil) spring. A front end portion 112 of the second switch contact 110, which extends from a coiled portion 111 of the second switch contact 110 and supported by a column 25*c* that projects upward from the bottom wall 25 is electrically connected to a connecting piece 114 made of metal which is electrically connected to the aforementioned mounting substrate. The connecting piece 114 is fixed to the front wall 26 via, for example, insert molding A rear end portion 113 of the second switch contact 110 is positioned behind the front wall 26 to face the rear end portion 103 of the first switch contact 100 in the forward/rearward direction.

In a state where the card 70 is in the temporarily-held state as shown in FIG. 7, the first switch contact 100 and the second switch contact 110 are not in contact with each other, so that the insertion (and installation) of the card 70 into the housing 20 (the presence of the card 70) is not detected. On the other hand, in a state where the card 70 is inserted into the housing 20 as shown in FIG. 9, the rear end portion 103 of the first switch contact 100 which is in contact with a front end surface 79 of the card 70 is in contact with the rear end portion 113 of the second switch contact 110 while being biased forward (upward as viewed in FIG. 9). Thereby the first switch contact 100 and the second switch contact 110 are electrically connected to each other, so that a card detecting circuit (not shown) electrically connected to the first switch contact 100 or the coiled portion 111 of the second switch contact 110 detects the insertion of the card 70 into the housing 20.

Since the first switch contact 100 and the second switch contact 110 are provided independently of the first coil spring 80, the second coil spring 82 and other constituents related to the insertion/ejection of the card 70 as described above, a highly-stable card insertion/ejection mechanism is achieved even if the size and weight of the card connector are reduced.

Furthermore, the above illustrated modified embodiment of the card connector operates normally even in each of the following cases: (1) the case where the card 70 inserted into the housing 20 is ejected by force, without following proper procedures, (2) the case where the card 70 is accidentally ejected by a dropping impact or the like, (3) the case where the structure (mechanism) for inserting/ejecting the card 70 is damaged by a factor such as an external force, and other cases (e.g., in the event of the occurrence of a malfunction).

The first switch contact 100 is configured so that the rear end portion 103 thereof comes into contact with the rear end portion 113 of the second switch contact 110 when the rear end portion 103 is pushed forward by the front end surface 79 of the card 70. Due to this structure, even if the card 70 is ejected due to malfunction even though the front end surface 50*a* of the slider 50 remains at the lock position P3, the aforementioned card detecting circuit can reliably detect that the card 70 is not inserted into the housing 20. Accordingly, the card detection capability operates normally, which causes no electrical damage to the electronic device in which the card connector is incorporated.

Furthermore, a helical torsion spring is used as the second switch contact 110 in the modified embodiment of the card connector. In recent years, due to miniaturization of the card and the associated card connector, the widths of the card and the card connector (the lengths thereof in a direction orthogonal to the forward/rearward direction) have been becoming increasingly smaller while maintaining the stroke (stroke in the forward/rearward direction) of the card at the time of insertion thereof. Under such circumstances, if the second switch contact 110 is replaced by a leaf spring, the length of the leaf spring needs to be short due to a limit of the widths of the card and the card connector, with no reduction in the stroke (the amount of displacement) in the forward/rearward direction, which makes it difficult to design the card connector. In contrast, adopting a helical torsion spring as the second switch contact 110 makes it possible to maintain a sufficient stroke of the card at the time of insertion thereof while achieving a reduction in width of the card and the card connector.

Note that the lock mechanism for locking and unlocking the slider 50 when the card 70 is in the insertion/installation position is not limited solely to the aforementioned combination of the arm 60 and the heart-shaped cam 55.

Although both the first coil spring 80 and the second coil spring 82 are compression coil springs in the above description, it is possible that both the first coil spring 80 and the second coil spring 82 be replaced by a first extension coil spring and a second extension coil spring, respectively. In this case, if the tensile force of the first extension coil spring is set to be greater than the tensile force of the second extension coil spring, an effect similar to the effect obtained in the above embodiments of the card connectors can be obtained.

Although the present invention has been discussed with reference to the specific embodiments described above, the present invention is not limited solely thereto. Obvious changes may be made in the specific embodiments of the present invention described herein, such modifications being within the spirit and scope of the invention claimed. It is indicated that all matter contained herein is illustrative and does not limit the scope of the present invention.

What is claimed is:

1. A card connector for accommodating a removable card, comprising:

a housing into and from which said removable card is inserted and ejected;

connector terminals which come in contact with contacts of said removable card, respectively, when said removable card is inserted into said housing;

a slider which moves in a card insertion direction and a card ejection direction, opposite to said card insertion direction, when said removable card is inserted and ejected into and from said housing, respectively;

a first coil spring which biases said slider in said card insertion direction;

a second coil spring which biases said slider in said card ejection direction, wherein each of said first coil spring and said second coil spring remains in contact with said slider and said housing, respectively, regardless of the position of said slider; and wherein a biasing force exerted on said slider by resiliency of said second coil spring is greater than a biasing force exerted on said slider by resiliency of said first coil spring.

2. The card connector according to claim 1, wherein said slider comprises a heart-shaped cam.

3. The card connector according to claim 1, further comprising a lock member for temporarily holding said removable card when said removable card is inserted into and ejected from said housing, said lock member being mounted to said slider.

4. The card connector according to claim 1, wherein said first coil spring and said second coil spring are coaxially arranged along said card insertion direction and said card ejection direction.

5. The card connector according to claim 4, wherein each of said first coil spring and said second coil spring comprises a compression coil spring.

6. The card connector according to claim 4, wherein said housing comprises a housing body and a housing cover which covers said housing body, wherein said slider is mounted on said housing body to be slidable thereon inside said housing, and wherein said first coil spring and said second coil spring are positioned on opposite sides of said slider along said card insertion direction and said card ejection direction.

7. The card connector according to claim 1, wherein said removable card comprises a memory card.

8. The card connector according to claim 7, wherein said memory card comprises a micro-sized SD memory card.

9. The card connector according to claim 4, wherein at least a part of said slider is held between a positioning portion formed on said housing and said second coil spring in a state where said removable card is not inserted into said housing.

10. The card connector according to claim 9, wherein said positioning portion projects toward said slider in a direction substantially orthogonal to said card insertion direction and said card ejection direction from said housing.

11. A card connector including a housing into which a removable card is inserted, comprising:

connector terminals arranged inside said housing and coming in contact with contacts of said removable card, respectively, when said removable card is inserted into said housing;

a slider positioned in said housing and slidingly movable in a card insertion direction and a card ejection direction, opposite to said card insertion direction, when said removable card is inserted and ejected into and from said housing, respectively;

a first spring which biases said slider in said card insertion direction;

a second spring which biases said slider in said card ejection direction, wherein said first coil spring and said second coil spring remain in contact with said slider from opposite directions, respectively, regardless of the position of said slider; and wherein each of said first spring and said second spring comprises a compression coil spring.

* * * * *